US005833208A

United States Patent [19]

Lee, Jr.

[11] Patent Number: 5,833,208

[45] Date of Patent: Nov. 10, 1998

[54] INNER SEAL FOR RAM-TYPE BLOWOUT PREVENTER

[75] Inventor: Albert H. Lee, Jr., Mt. Enterprise, Tex.

[73] Assignee: JM Clipper Corporation, Nocogdoches, Tex.

[21] Appl. No.: 929,596

[22] Filed: Sep. 15, 1997

[51] Int. Cl.[6] ..... E21B 33/06

[52] U.S. Cl. ..... 251/1.3; 251/1.1

[58] Field of Search ..... 251/1.1, 1.3

[56] References Cited

U.S. PATENT DOCUMENTS 2,278,050 3/1942 Allen et al. ..... 251/1.3 X 3,434,729 3/1969 Shaffer et al. ..... 251/1.3 X 4,229,012 10/1980 Williams, III .

4,398,729 8/1983 Bishop et al. .

5,127,623 7/1992 McDugle .

*Primary Examiner*—John Fox

*Attorney, Agent, or Firm*—Richard A. Speer; Mayer Brown & Platt

[57] ABSTRACT

A resilient sealing insert for use in a ram-type blowout preventer the insert having an outer sealing surface enclosing an angle of less than 180° and sealing faces that extend radially outwardly from the outer sealing surface in a plane substantially normal to the axis of generation of the arcuate sealing surface.

7 Claims, 2 Drawing Sheets

INNER SEAL FOR RAM-TYPE BLOWOUT PREVENTER

FIELD OF THE INVENTION

This invention relates to an inner seal for a ram-type blowout preventer for oilfield drilling equipment and more particularly to such an inner seal on a packer including a removable insert for sealing tightly against a tubular member.

BACKGROUND OF THE INVENTION

Heretofore, inner seal assemblies have been provided for ram-type blowout preventers on oilfield drilling equipment for sealing the annulus about a tubular member such as a drill pipe. A blowout preventer normally has two opposed ram blocks mounted for inward movement toward each other for sealing engagement with the pipe. Each ram block has a packer formed of an elastomeric or hard rubber material engaging the outer periphery of the pipe with the packers deforming against the pipe to form a tight seal. Each packer has an arcuate opening or recess to receive the pipe and form a tight seal with 180° of the outer periphery of the pipe. Examples of such blowout preventers are shown in U.S. Pat. Nos. 1,695,992 dated Dec. 18, 1928 and 3,272,222 dated Sep. 13, 1966.

During a stripping operation, the drill pipe is pulled from the well bore with the blowout preventer in sealing relation against the drill pipe and frictional contact between the blowout preventer and the pipe being removed may result in considerable wear against the seal. For that reason, a wear insert may be added to the packer for contacting the pipe. For example, as shown in U.S. Pat. No. 4,398,729 dated Aug. 16, 1983, a semi-circular insert is provided formed of a suitable resilient material which may include a nylon and/or urethane material. Such a semicircular insert is received within a recess in the packer and is urged against the elastomeric packer when contacting the drill pipe under substantial fluid pressure from the ram. The insert illustrated in U.S. Pat. No. 4,398,729 includes a pair of integral outwardly extending projections which are received within corresponding grooves for mounting of the insert within the packer. The resilient insert is depressed inwardly when initially inserted within the grooves to provide yieldable cooperation between the insert and the packer.

Screws or nails have also been utilized heretofore for retaining the insert in position within the elastomeric packer. However, upon closing of the ram and rotation of the drill pipe, the screws or nails tend to strip out of the elastomeric packer and if the fasteners are stripped from the elastomeric packer, the insert will spin or rotate with the drill pipe.

U.S. Pat. No. 5,127,623 illustrates another configuration of insert for use in a ram-type blowout preventer in which the resilient insert is formed with one or more rearwardly extending lugs that are configured to fit within an indentation formed in the packer. The cross-sectional shapes of the extension(s) and the indentation are made non-circular, so that the insert will resist any twisting with respect to the packer.

SUMMARY OF THE INVENTION

The present invention is directed to an inner seal on a body shape packer including a removable insert of sealing tightly against the pipe. The insert is received within an arcuate recess in the elastomeric packer. The insert may have lugs which fit within corresponding grooves in the semicircular recess or the inner body portion may be of a shape, such as rectangular, to resist any tendency for the insert to rotate. The insert is slidable into and out of the indentation within any yielding or deformation of the insert being required and can be secured within the recess to the elastomeric packer by separate fasteners, such as screws. The body shape guides and positions the insert accurately within the recess for securement by the separate fasteners.

When the blowout preventer is closed about the pipe the resilient insert is urged outwardly in a generally radial direction against the elastomeric packer until the adjacent sealing faces of the packer are in tight sealing contact with the pipe. Since the insert is pressed radially outwardly into the elastomeric packer during sealing about the pipe, it is desirable to have the insert extend radially inwardly beyond the packer in a rest or opened position of the packer. As mentioned earlier, removal of the drill pipe during stripping operations results in considerable wear of the packer insert, thereby reducing the operational lifetime of the sealing apparatus. One way in which the insert usable life could be extended is described in U.S. Pat. No. 5,127,623 where the arcuate length of the insert exceeds 180° to provide extra length on the sealing face which is initially compressed and then relaxed as wear occurs.

The present invention makes it possible to obtain even longer insert operating life by providing packer inserts in which the cooperating sealing ends do not initially abut but are rather spaced apart and formed with overlapping mating portions that provide an effective seal while simultaneously permitting the inserts to be moved toward each other to compensate for wear.

It is an object of this invention to provide a long lasting resilient insert for an elastomeric packer of a ram-type blowout preventer for sealing the annulus about a tubular member.

It is a further object of this invention to provide such an insert which has an arcuate sealing surface less than 180° and which has end portions that are formed to overlap and create sealing surfaces that are contained in a plane substantially normal to the axis of generation of the arcuate sealing surface to provide the insert means for compensatory for wear.

Other objects, features, and advantages of this invention will be apparent from the following specification and drawings.

DESCRIPTION OF THE INVENTION

Figure 1:
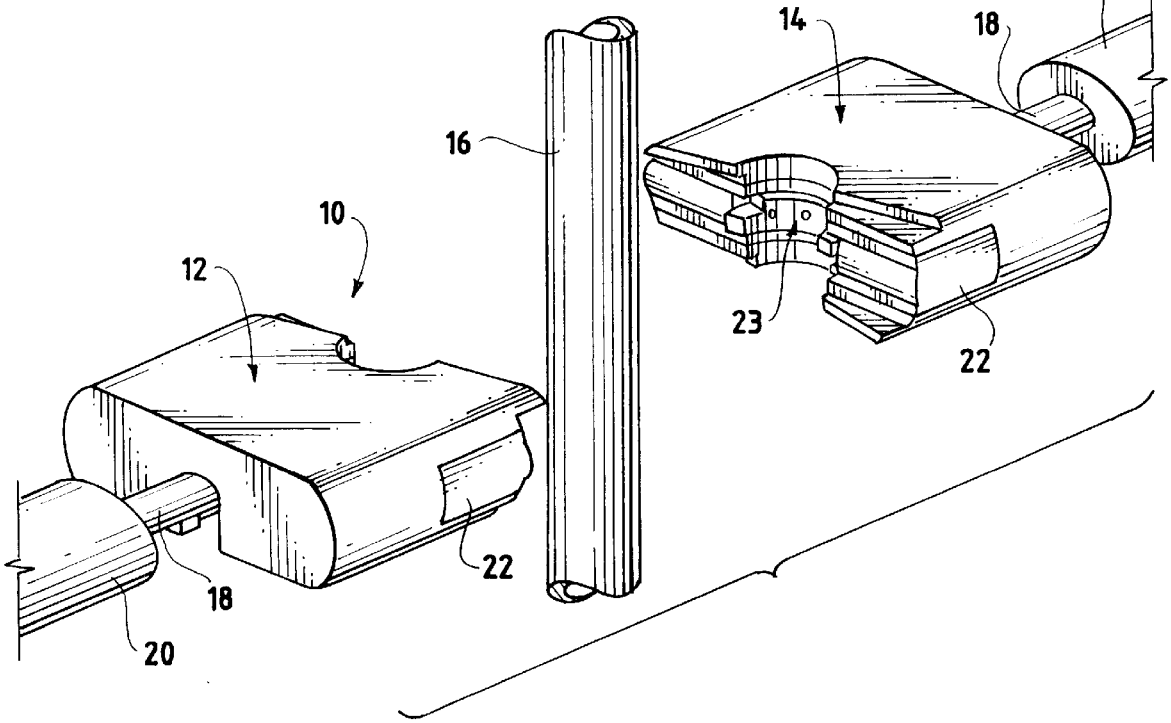
FIG. 1 is perspective, partly schematic, of a portion of a ram-type blowout preventer showing the ram body and packer for sealing against a pipe and including the insert comprising the present invention.

Referring to the drawings for a better understanding of this invention and more particularly to FIG. 1, a portion of ram-type blowout preventer for oilfield drilling equipment is shown generally at 10 with a pair of opposed ram bodies indicated generally at 12 and 14 for fitting about the outer periphery of a pipe 16 from a bore hole (not shown) in sealing relation upon closing of the blowout preventer. Each ram body 12, 14 is connected to a piston rod 18 extending from a fluid cylinder 20 for movement of the associated ram body in a radial direction when closed in sealing relation about pipe 16.

The inner seal assembly is formed by an elastomeric packer shown generally at 22 and a removable resilient insert carried by packer 22 and indicated generally at 23. Packer 22 is an integrally molded structure including a pair of upper and lower metal plates 24 and a pair of outwardly extending studs 26. A suitable elastomeric member 28 such as rubber is molded or bonded about plates 24 and studs 26 to form packer 22. Studs 26 are removably secured to body 12 along with a top seal (not shown) for securement of packer 22.

Figure 2:
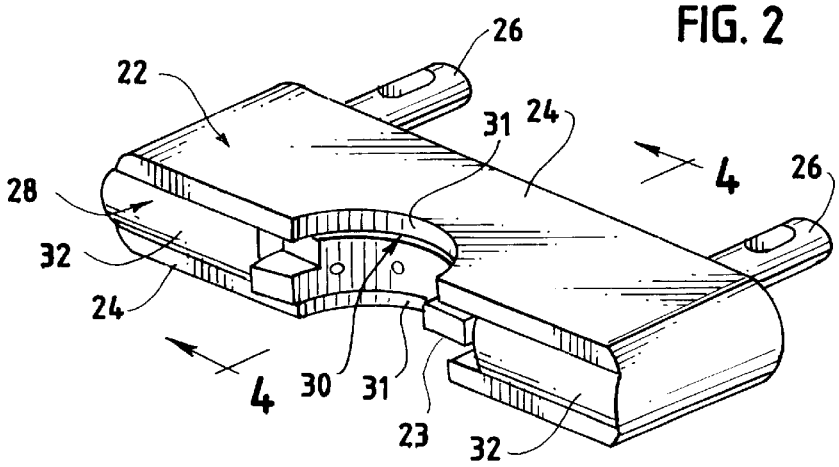
FIG. 2 is a perspective view of the packer and insert removed from the ram body.

Referring to FIG. 2, an arcuate opening 30 in packer 22 defined by arcuate surfaces 31 on plates 24 is provided in the sealing face of packer 22 and generally planar end sealing faces 32 are provided adjacent semicircular opening 30 for engaging similar opposed end faces on opposed ram body 12. A generally semicircular recess 34 is provided in the elastomeric member 28 between plates 24 and an indentation 36 of generally rectangular shape (see FIG. 3) extends radially outwardly of recess 34. Indentation 36 defines a pair of parallel planar side surface 38 extending in a direction at right angles to the generally planar end sealing faces 32 of packer 22 and connected by a rear planar surface 40.

Resilient insert 23 forms an important part of this invention and is adapted to fit within recess 34 of packer 22. Insert 23 is of an arcuate shape having a rectangular cross section defining inner and outer concentric peripheral surfaces 46 and 44, respectively and lower and upper planar surfaces 48, 50. 23. Openings 54 extend through insert 23 and are adapted to receive suitable fasteners, such as wood screws 56 for securing insert 23 to the elastomeric material of packer 22. The inner portion 58 of insert 23 extends rearwardly from outer peripheral surface 46 for guiding and positioning insert 23 accurately within recess 34. Portion 58 has a pair of planar parallel side surfaces 60 extending in a direction at right angles to the end sealing faces 32 of packer 22 to permit sliding positioning of insert 23 within recess 34 with body 58 recessed within indentation 36 without any yielding of insert 23. Likewise insert 23 may be easily removed from recess 34 without any yielding. A planar rear end surface 62 extends between planar side surfaces 60.

Since insert 23 is subjected wear particularly during a stripping operation in which the pipe is removed while the blowout preventer is in a closed sealed position about the pipe, it is desirable to provide the insert with a substantial inner marginal portion thereof which may be worn away by frictional contact with pipe and yet provide an effective seal against the pipe when the blowout preventer is in closed position about the pipe.

Figure 3:
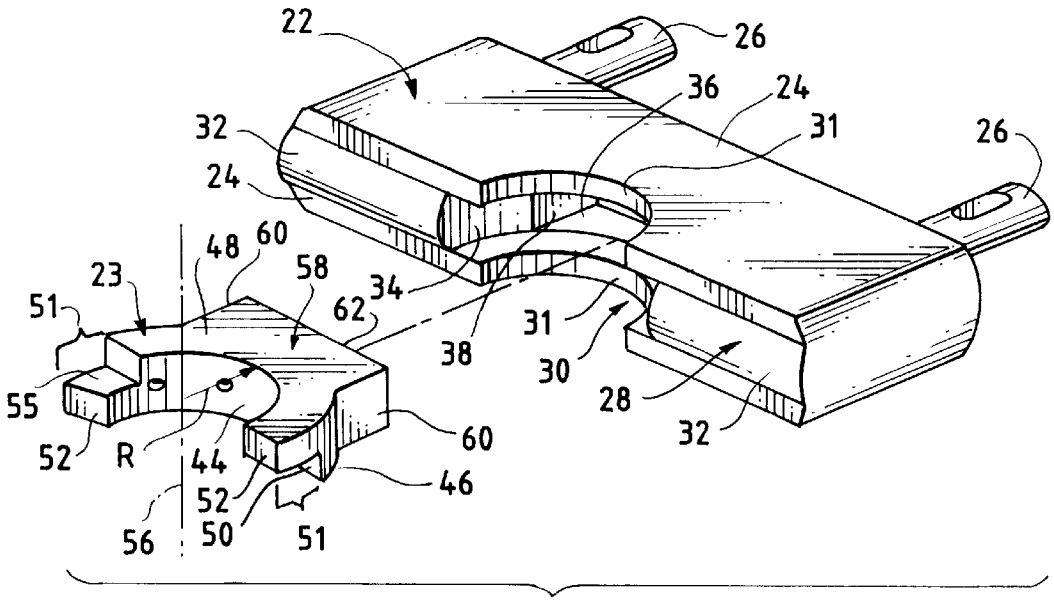
FIG. 3 is an exploded view of the packer and insert of FIG. 2.
Figure 4:
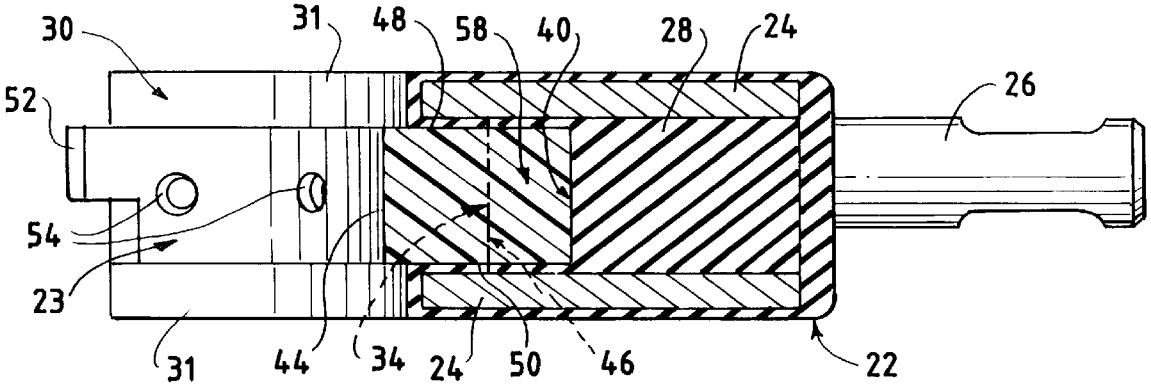
FIG. 4 is a section taken generally along line 4—4 of FIG. 2.

The insert design of this invention permits the inserts 23 to wear longer and thereby reduce down time on the rig by providing a self-feeding end seal design, as best shown in FIGS. 2 and 3 of the drawings. It can be seen that the ends 51 of insert 23 have been made of a reduced cross-sectional area, as compared to the rest of the body. Thus each end 51 has an outer end extension 52 of reduced cross-sectional area that creates horizontally disposed (as viewed in FIG. 3) end seal faces 55 which extend radially outwardly from the arcuate outer sealing surface 44 in a plane substantially normal to the axis of generation 56 of sealing surface 44. As the ends 51 of opposed, cooperating seals 23 are designed to overlap so that the faces 55 of each insert are in contact, the angle enclosed by arcuate sealing surface 44 is designed to be less than 180°. Generally the arcuate length of sealing face 14 can extend over an angle of from about 155° to 175°. Restricting the length of surface 44 insures that sealing surface 53 will be sufficiently long to preclude the terminal surfaces of ends 51 from coming into contact, until appreciable wear has occurred through use. An additional rubber seal can be inserted between the surfaces of the overlapping faces 55 to further insure and prevent any leakage around the pipe.

While extensions 52 are shown as being located on opposite sides of insert 23, it is obvious that both extensions on one insert can be located on one side so that on the cooperating insert they will be located on the opposing side. That is, rather than staggering the extensions 52 as shown in FIG. 3, the same effect is created if the extensions are continuations of upper and lower insert surfaces 48 and 50, respectively. Alternatively the inserts can be formed to have a cooperating male/female configuration so that the portions of reduced cross-sectional area define a plurality of sealing surface 55 that are spaced apart along the axis 56. While the present description shows the areas of insert cross-sectional area located on the ends of the insert, it is to be understood that the overlapping sealing surfaces can be at other locations. For example, the insert shown in FIG. 3, the ends 52 of reduced area could be made to be of full cross-section and the overlapping sealing surfaces created by dividing insert 23 along its centerline and making the overlap along this line. The significance is in providing sealing surfaces which are oriented as previously described so that the insert can accommodate substantial wear before replacement is required.

From the foregoing, it is apparent that substantial wear may occur along the inner peripheral surface 44 of insert 23 while insert 23 maintains its sealing capacity against the outer peripheral surface of pipe 16. Further, any rotation of pipe 116 when packers 22 are in closed position tending to rotate or twist inserts 23 is resisted by body 58 fitting within indentations 36. Thus, fasteners 56 are not subjected to any shear forces tending to dislodge the fasteners. Body 58 and containing indentation 36 by having planar side surfaces 60 and 38 extending at right angles to planar seal faces 32 guide and position the associated insert 23 accurately within recess 34 without any yielding or bending of insert 23. Insert 23 may be formed of various resilient materials which have desired wear characteristics such as thermoplastic materials. A material which has been found to be satisfactory in ultra high molecular weight polyethylene (UHMWP). Other suitable materials may include nylon, urethane, or nitride-butadiene for example.

While a preferred embodiment of the present invention has been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. An inner seal for a ram body of a ram-type blowout preventer comprising:

a packer having a generally planar sealing face with an arcuate opening therein and an arcuate recess adjacent the opening defining at least one indentation therein, which indentation extends in a direction generally perpendicular to the generally planar sealing face;

a resilient insert mounted within the arcuate recess of the packer, the insert comprising an outer arcuate sealing surface enclosing an angle of less than 180° and an inner body portion that is received into the indentation of the packer and is shaped to resist rotative movement of the insert relative to the packer; and sealing faces on the insert which extend radially outwardly from the outer arcuate sealing surface and are contained in a plane substantially normal to the axis of generation of the arcuate sealing surface.

2. An inner seal assembly as defined in claim 1 wherein portions of the insert are of reduced cross-sectional area compared to the remainder of the insert body, to create sealing faces on the insert which are contained in a plane substantially normal to the axis of generation of the accurate sealing surface and which mate in overlapping sealing relationship with cooperating sealing faces on ends of another insert body.

3. An inner seal assembly as defined in claim 2 wherein the reduced cross-sectional areas of the insert are located adjacent opposed surfaces of the insert body.

4. An inner seal assembly as defined in claim 2 wherein the reduced cross-sectional areas are located adjacent the same surface of the insert body.

5. An inner seal assembly as defined in claim 2 wherein the cross-sectional areas of the insert is about 50% of the cross-sectional area of the insert body.

6. An inner seal for a ram body of a ram-type blowout preventer as defined in claim 1 wherein the arcuate outer sealing surface encloses an angle within the range of from about 155° to 175°.

7. An inner seal assembly as defined in claim 2 wherein the portions of reduced cross-sectional area define a plurality of sealing surfaces that are spaced apart along the axis of generation of the arcuate sealing surface.

* * * * *